US006446480B1

(12) United States Patent
Van Dyke et al.

(10) Patent No.: US 6,446,480 B1
(45) Date of Patent: Sep. 10, 2002

(54) PROCESS FOR PRODUCING IMPROVED RAIL

(75) Inventors: Verlan Van Dyke; Keith Korver, both of Pella; Perry Klein, West Des Moines, all of IA (US)

(73) Assignee: VGK, Inc., Pella, IA (US)

( * ) Notice: Subject to any disclaimer, the term of this patent is extended or adjusted under 35 U.S.C. 154(b) by 0 days.

(21) Appl. No.: 09/776,532

(22) Filed: Feb. 2, 2001

(51) Int. Cl.[7] ..... B21B 1/08
(52) U.S. Cl. ..... 72/366.2; 104/93
(58) Field of Search ..... 104/93, 118; 105/141, 105/148; 198/465.4; 72/199, 365.2, 366.2

(56) References Cited

U.S. PATENT DOCUMENTS

| | | | | |
|---|---|---|---|---|
| 488,734 | A | * 12/1892 | Giroux | 104/93 |
| 2,566,962 | A | 9/1951 | Ramsey | |
| 2,581,948 | A | 1/1952 | Flounders | |
| 2,718,852 | A | 9/1955 | Cacciatore | |
| 3,206,965 | A | 9/1965 | Gauer | |
| 3,252,427 | A | 5/1966 | Bailey | |
| 3,343,394 | A | 9/1967 | Gauer | |
| 3,400,566 | A | 9/1968 | Gauer | |
| 3,587,275 | A | * 6/1971 | Brennan | 72/199 |
| 3,724,387 | A | 4/1973 | Civitarese | |
| 3,738,477 | A | 6/1973 | Gename | |
| 3,787,925 | A | 1/1974 | Dawson | |
| 3,902,432 | A | 9/1975 | Shortridge et al. | |
| 3,971,601 | A | 7/1976 | Sytsma | |
| 3,996,780 | A | * 12/1976 | German | 72/197 |
| 4,116,134 | A | 9/1978 | Troth | |
| 4,341,161 | A | 7/1982 | Morita et al. | |
| 4,359,945 | A | * 11/1982 | Brems et al. | 104/93 |
| 4,384,387 | A | 5/1983 | Pachuta | |
| 4,423,685 | A | 1/1984 | Kerckhoff | |
| 4,467,913 | A | 8/1984 | Salloum | |
| 4,520,733 | A | 6/1985 | Willmann | |
| 4,639,046 | A | 1/1987 | Oleff et al. | |
| 4,902,188 | A | 2/1990 | Page | |
| 5,156,533 | A | 10/1992 | Hoffman et al. | |
| 5,231,933 | A | 8/1993 | DiRosa | |
| 5,398,618 | A | 3/1995 | McMullen | |
| 5,468,080 | A | 11/1995 | Jones | |
| 5,470,274 | A | 11/1995 | Kadi et al. | |
| 5,479,862 | A | 1/1996 | Waterkamp | |
| 5,615,617 | A | 4/1997 | Benest | |
| 5,658,030 | A | 8/1997 | Ghosh et al. | |
| 5,664,502 | A | 9/1997 | Wilhelm | |

* cited by examiner

*Primary Examiner*—Lowell A. Larson
(74) *Attorney, Agent, or Firm*—Brett J. Trout

(57) ABSTRACT

A process for creating a curved rail for use by a trolley by providing a rail having a first side, a second side, a third side, a first edge located between said first side and said second side, and a second edge located between said second side and said third side. The process comprises pinching the first edge and second edge with sufficient force to provide a substantially constant curvature across a majority of said second side. The pinching is not only inexpensive, but also hardens the surface of the rail.

19 Claims, 3 Drawing Sheets

PROCESS FOR PRODUCING IMPROVED RAIL

FIELD OF THE INVENTION

This invention relates to a system for producing an improved rail, and more particularly, to a system for inexpensively producing a rail with a curved section, having improved hardness and wear characteristics.

BACKGROUND OF THE INVENTION

Animal carcasses are transported in meatpacking plants, typically through the use of meat hooks. Each meat hook is secured to a wheel by a strap or other connection means to form a trolley. The trolleys move along a system of rails to transport the carcasses from place to place. Each trolley typically includes a wheel having a recessed rolling surface, which rides along the rails. A typical meatpacking operation may employ hundreds or thousands of such trolleys, and miles of rail.

Wheel flange, are typically provided on prior art trolley wheels to maintain the wheels on the prior art track, which is typically of a rectangular cross-section. Although this arrangement maintains trolleys on the rail, it has several drawbacks. One drawback is associated with the fact that such prior art trolleys typically do not take a straight-line path along the rail. Instead, the trolleys typically weave back and forth, alternately contacting opposite flanges against the rail. The flanges often rub against the rail with sufficient force to dislodge metallic shavings from the rail and flanges, This abrasion not only prematurely wears both the trolley and the rail, but also contaminates the carcass with metal shavings. Additionally, as the wear continues, the space between the rail and flanges increases, thereby exacerbating the problem, and causing more wear to both the rail and flanges. Although oil may be added to the rail to reduce the abrasion, oil itself is a contaminate which, like the metal shavings, tends to fall from the trolley onto the animal carcass, which it contaminates.

Although it would be desirable to provide a curved surface along the rail and a mating curved surface on the trolley, milling such a curved surface into the rail is relatively expensive. Additionally, as the curved surface is subjected to a substantial amount of contact with the trolley, the curved surface would immediately begin to wear, and would eventually have to be replaced. It would, therefore, be desirable to provide a curved rail constructed out of a hardened material, such as hardened stainless steel. The cost associated with milling and hardening stainless steel is often prohibitively expensive.

It would be desirable to provide a rail with a curved surface which may be quickly and inexpensively constructed. It would be additionally advantageous to provide the curved surface with an increased hardness, to reduce the likelihood of contaminates in the form of metal shavings being dislodged from the rail, and to eliminate the need for oil or other contaminate having to be applied between the rail and the trolley.

The difficulties encountered in the prior art discussed hereinabove are substantially eliminated by the present invention.

SUMMARY OF THE INVENTION

In an advantage provided by this invention, a process is provided for producing a trolley rail of increased durability.

Advantageously, this invention provides a process for inexpensively producing a curved stainless steel rail.

Advantageously, this invention provides a process for producing a trolley rail which reduces contamination of carcasses transported along the rail.

Advantageously, this invention provides a process for producing a trolley rail which increases the longevity of trolleys transported thereupon.

Advantageously, this invention provides a process for producing a trolley rail which reduces the abrasion of trolleys transported thereupon.

A process for creating a curved rail is provided, comprising providing a rail having a first side, a second side, and a third side, with a first edge provided between the first side and the second side, and a second edge provided between the second side and the third side. In the preferred embodiment, the rail is of a rectangular cross-section, with the first side and second side meeting at a ninety-degree angle at the first edge, and the second side and third side meeting at a ninety-degree angle at the second edge. The process further comprises pressing against the first edge and the second edge with sufficient force to provide the second side with a rounded surface of a substantially constant curvature from the first side to the third side.

Preferably, the first edge and second edge are "pinched" by being pressed into a plurality of cavities provided on separate rotating wheels. Each wheel presses the edges more, until the edges become a curvature of a substantially constant radius from the first side to the third side of the rail. By pinching the edges, instead of milling them down, the curved surface of the second side of the rail is provided with increased hardness, thereby increasing its durability and longevity.

BRIEF DESCRIPTION OF THE DRAWINGS

This invention will now be described, by way of example, with reference to the accompanying drawings, in which.

DETAILED DESCRIPTION OF THE PREFERRED EMBODIMENT

Figure 1:
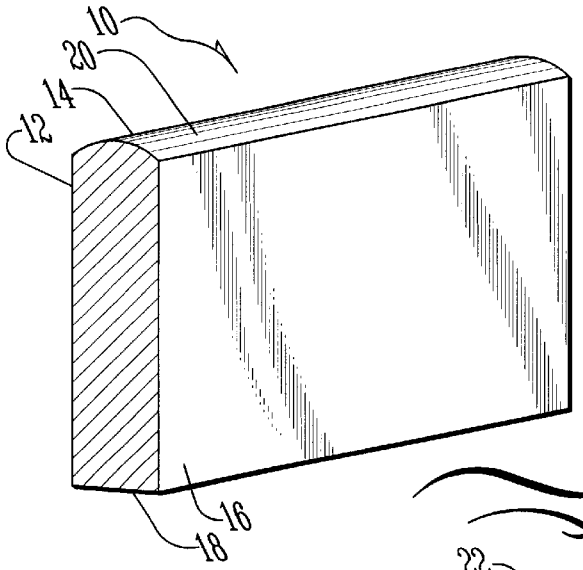
FIG. 1 illustrates a front perspective view in cross-section of the improved rail of the present invention.

The improved trolley rail of the present invention is shown generally as (10) in FIG. 1. The rail (10) is preferably constructed of 304 stainless steel, or similar corrosion resistant material. Of course, any type of stainless steel or other malleable, abrasion resistant material may be substituted, without departing from the scope of the invention. The improved trolley rail (10) is provided with a first side (12), a second side or "top" (14), a third side (16), and a fourth side or "bottom" (18). The width of the rail (10) between the first side (12) and third side (16) is approximately 1.25 centimeters, but may, of course, be of any suitable dimensions; preferably greater than 0.1 centimeters and narrower than fifty centimeters, and more preferably greater than 0.5 centimeters and narrower than ten centimeters. The height from the bottom (18) to the uppermost portion of the top (14) of the rail is approximately 6.35 centimeters. This distance is preferably greater than 0.5 centimeters and less than one meter, and, more preferably, greater than 0.5 centimeters and less than twenty centimeters.

Figure 3:
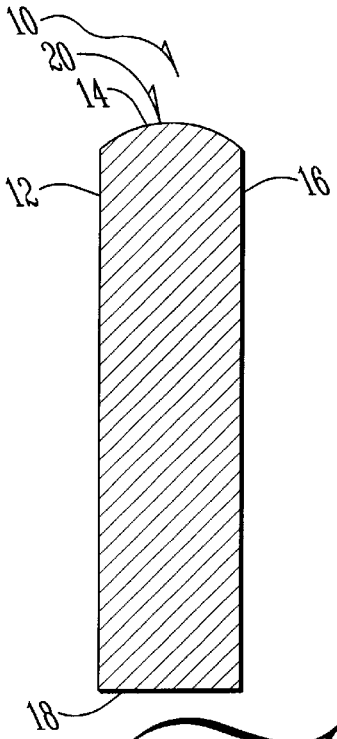
FIG. 3 illustrates a front elevation of the improved rail of the present invention.

The top (14) of the rail (10) is provided with a curved surface (20) of a curvature defining a radius of approximately one-centimeter. (FIG. 3). The curved surface (20) may, of course, define a radius of any suitable dimensions, but is preferably of a substantially constant curvature from the first side (12) to the third side (16). The curvature of the curved surface (20) preferably defines a radius between twenty centimeters and 0.625 centimeters, and, more preferably, between five centimeters and one centimeter.

Figure 2:
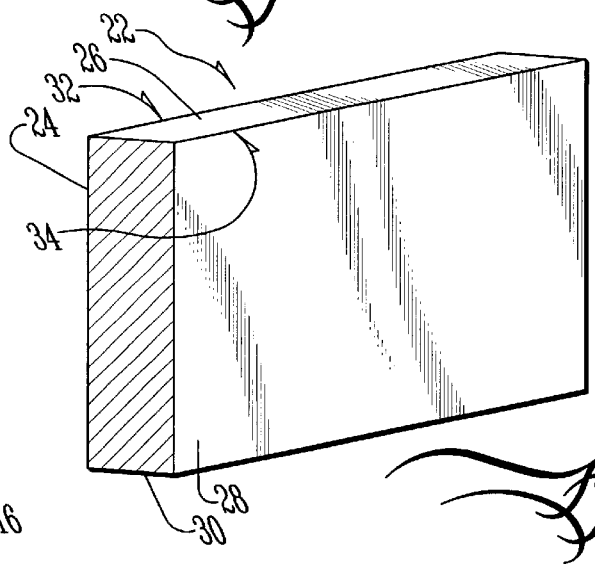
FIG. 2 illustrates a front perspective view in cross-section of a standard stainless steel rail from which the improved rail of the present invention is constructed.

To create the improved trolley wheel (10) of the present invention, a standard piece of stainless steel bar (22), having the desired finish and hardness is provided as shown in FIG. 2. In the preferred embodiment, the bar (22) is provided with a first side (24), a second side or "top" (26), a third side (28), and a fourth side or "bottom" (30). Additionally, the bar (22) is provided with a first edge (32), connecting the first side (24) and top (26) at a ninety degree angle, and a second edge (34), connecting the third side (28) and top (26) at a ninety degree angle.

In accordance with the process of the present invention, the bar (22) is formed into the rail (10) by applying pressure to the first edge (32) and second edge (34) of the bar (22) of a sufficient magnitude and at an appropriate location to provide the curved surface (20), shown in FIG. 1. In the preferred embodiment, the pressure is applied to the edges (32) and (34) through a modified process of "Gauering," a process described in U.S. Pat. Nos. 3,343,394, and 3,400 566, both of which are incorporated herein by reference. The Gauering process described in these applications involves the use of a wheel or "roll" provided on its perimeter with a recess into which a piece of bar stock is provided. The sides of the recess are then resiliently forced against the edges of the bar stock to remove the sharp edges of freshly split bar stock. Although Gauering is capable of removing sharp edges from metal, the recesses used in association with prior art Gauering are insufficient to provide the continuous curved surface of the present invention.

Figure 4:
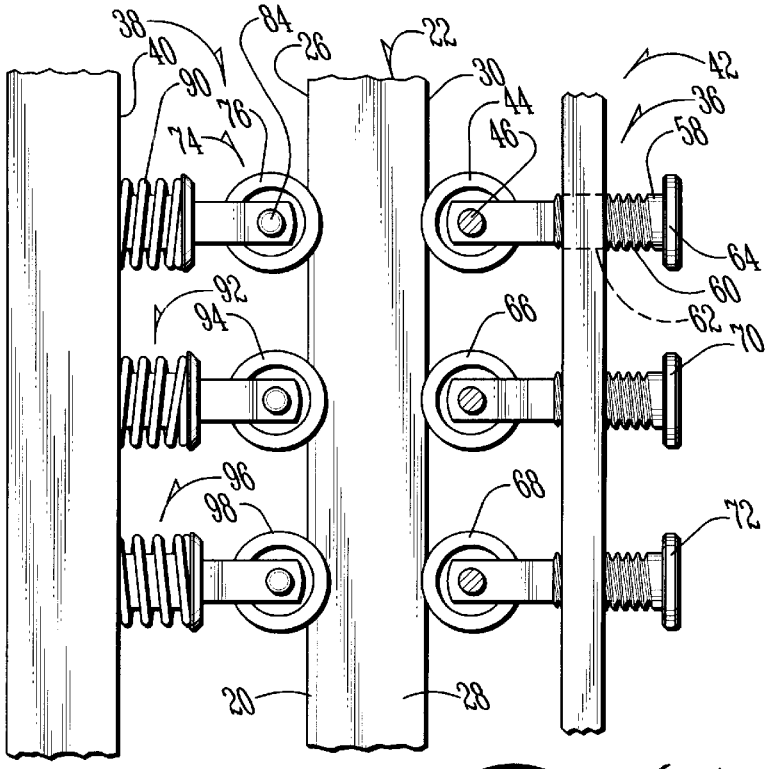
FIG. 4 illustrates a top plan view of the railmaking apparatus of the present invention.

In the present invention, as shown in FIG. 4, a plurality of pressure roller assemblies (36) is provided in contact with the bottom (30) of the bar (22). Similarly, a plurality of roll assemblies (38) are provided in contact with the top (26) of the bar (22). Both the pressure roller assemblies (36) and roll assemblies (38) are coupled to a frame of the railmaking apparatus (42). Preferably, the frame (40) is constructed of steel or similarly sturdy material, and forms a hollow box, within which art provided the pressure roller assemblies (36) and roll assemblies (38).

Figure 5:
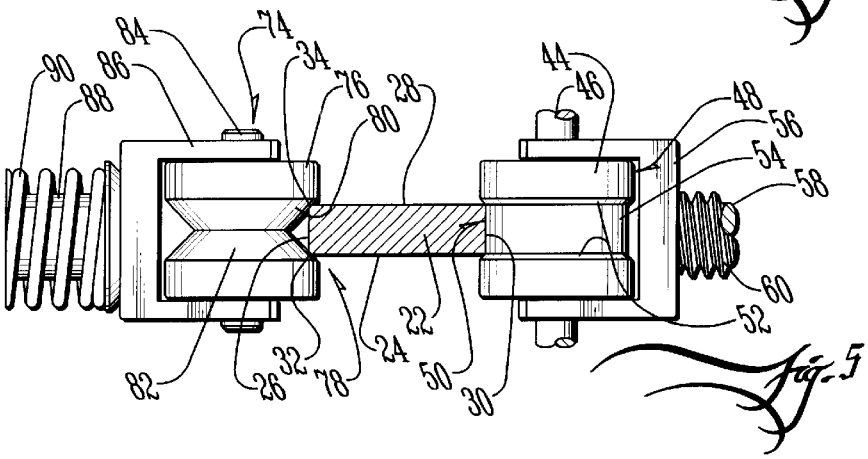
FIG. 5 illustrates a front elevation of the first roll assembly and pressure roller of FIG. 4.

As shown in FIG. 4, the pressure roller assemblies (36) comprise a pressure roller (44) provided around an axle (46). The pressure roller (44) is preferably constructed of hardened steel or similarly abrasion-resistant hard material. As shown in FIG. 5, the pressure roller (44) is provided along its perimeter (48) with a recess (50) to accommodate the bottom (30) of the bar (22).

As shown in FIG. 5, the recess (50) includes a pair of inwardly angled sides (52), terminating in a race (54). In the preferred embodiment, the race (54) is preferably of a width identical to the width of the bottom (30) of the bar (22). As shown in FIG. 5, the bottom (30) of the bar (22) preferably rests within the recess (50) and rides along the race (54) of the pressure roller (44). The angled sides (52) assist in maintaining the bottom (18) centered within the recess (50). Alternatively, the angled sides (52) may be parallel to the sides (24) and (28) of the bar (22), to maintain the bar more securely within the recess (50).

As shown in FIG. 5, the axle (46) of the pressure roller (44) is journaled to a shoulder mount (56), constructed of steel or similarly rigid material. Journaled to the shoulder mount (56) is a shaft (58). In the preferred embodiment, in addition to being journaled to the shoulder mount (46), the axle (46) is slidably provided within slots (not shown) of the frame (40) of the railmaking apparatus (42), to prevent the shoulder mount (56) and pressure roller (44) from pivoting relative to the bar (22). As shown in FIG. 4, the shaft (58) is provided with threads (60) provided in threaded mating alignment with a threaded bore (62), provided in the frame (40) of the railmaking apparatus (42). Coupled to the end of the shaft (58) is a wheel (64). As shown in FIG. 4, as the wheel (64) is rotated, the threads (60) of the shaft (58) coact against the threaded bore (62) to move the pressure roller (44) relative to the frame (40).

As shown in FIG. 4, the railmaking apparatus (42) is also provided with a second pressure roller (66) and third pressure roller (68), coupled to their respective wheels (70) and (72) in a similar manner to that described above in relation to the pressure roller (44). Depending on the size of the bar (22) and the curvature of the desired curved surface (20), the railmaking apparatus (42) may be provided with any suitable number of pressure rollers. A larger number of rollers allows the use of softer and less expensive rolls, and increases the uniformity of the curvature (20) of the rail (I0).

As shown in FIG. 4, on the opposite side of the bar (22), coupled to the top (26) of the bar (22), are the roll assemblies (38). As shown in FIG. 5, the first roll assembly is provided with a roll (76) having a recess (78). As shown in FIG. 5, the recess (78) is preferably of a V-shaped cross-section, having a first angled surface (80) and a second angled surface (82). These angled surfaces (80) and (82) are preferably hardened to reduce any deflection thereof by the bar (22). The roll (76) itself is preferably constructed of stainless steel or similar material. The angle of the angled surfaces (80) and (82) relative to one another are dictated by the thickness of the steel bar (22), hardness of the steel bar (22), and desired angle of the curved surface (20).

As shown in FIG. 5, the roll (76) is journaled to an axle (84), which is journaled to a shoulder mount (86), similar to the shoulder mount (56) described above in relation to the pressure roller (44). The shoulder mount (86) is secured to a shaft (88) which, in turn, as shown in FIG. 4, is secured to a coil spring (90), or similar resilient mechanism known in the art. Also as shown in FIG. 4, the coil spring (90) is secured to the frame (40). The size and tension of the spring (90) is dictated by the dimensions of the rail (10) being constructed, but are preferably sufficient to apply enough pressure to deform the edges (32) and (34) of the bar (22).

Figure 6:
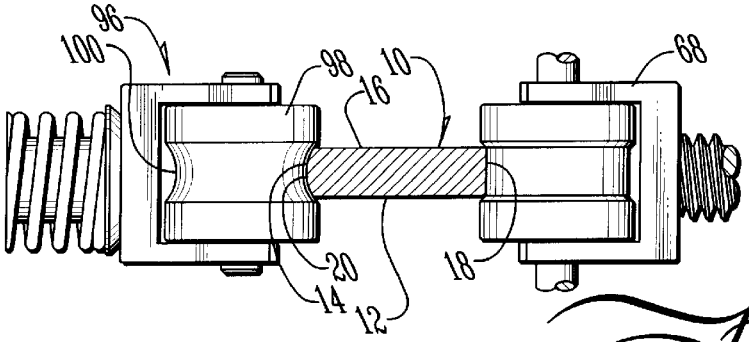
FIG. 6 illustrates a front elevation of the third roll assembly and pressure roller of FIG. 4.

As shown in FIG. 4, the railmaking apparatus (42) is also provided with a second roll assembly (92), provided with a roll (94) having angled surfaces (not shown) which are slightly curved, rather than straight like the angled surfaces (80) and (82) associated with the first roll assembly (74). The railmaking apparatus (42) is also provided with a third roll assembly (96). As shown in FIG. 6, the third roll (98) is provided with a curved recess (100), with dimensions substantially similar to the dimensions of the curved surface (20) of the top (14) of the rail (10).

As will be obvious to those of ordinary skill in the art, the railmaking apparatus (42) may be provided with any desired number of rolls, each having recesses, gravitating more and more toward the angle of the curved surface (20) desired for the top (14) of the rail (10).

In operation, the bar (22) is provided between the pressure roller (44) and the roll (76). The wheel (64) is then rotated to activate the threads (60) against the threaded bore (62) to advance the pressure roller (44) toward the roll (76), until the top (26) of the bar (22) moves into contact with the angled surfaces (80) and (82) of the roll (76). After such contact, the wheel (64) is further turned until the spring (90) yields under pressure and the pressure roller (44) exerts a compressive force against the bottom (30) of the bar (22). The wheel (64) is cranked sufficiently to maximize the compressive force of the edges (32) and (34) of the bar (22) against the angled surfaces (80) and (82), without damaging the angled surfaces (80) and (82).

Accordingly, as shown in FIG. 5, as the bar (22) moves between the pressure roller (44) and roll (76), the edges (32) and (34) of the bar (22) are flattened. Not only does this flattening begin to provide the curved surface (20) of the finished rail (10), but the compression also provides additional hardening to the top (26) of the bar (22), thereby increasing its durability. As the bar (22) passes between the second pressure roller (66) and second roll assembly (92), the second wheel (70) is turned to compress the bar (22) against the second roll assembly (92). The top (26) of the bar (22) is pressed toward the desired curved surface (20) of the rail (10), forcefully enough to compress and curve the edges (32) and (34) of the bar (22), without damaging the second roll assembly (92).

As the bar (22) continues to move between the third pressure roller (68) and third roll assembly (96), the third wheel (72) is turned to apply sufficient pressure against the third pressure roller (68) and bar (22), to compress the top (26) of the bar (22) into the desired curved surface shape defined by the recess (100) of the third roll (98), without damaging the third roll (98). Accordingly, as the bar (22) passes through the railmaking apparatus (42), between the pressure roller assemblies (36) and roll assemblies (38), the roll assemblies (38) continue to push and curve the edges (32) and (34) of the bar (22) inward, until the top (26) of the bar (22) takes the desired curved surface (20) shape of the top (14) of the finished rail (10). By providing a plurality of roll assemblies (38), and applying sufficient pressure with the wheels (64), (70) and (72), a substantially continuous curved surface (20) may be provided along the top (14) of the rail (10). Additionally, as the roll assemblies (38) apply pressure to the edges (32) and (34) of the steel bar (22), the resulting curved surface (20) of the top (14) of the rail (10) is distinctly hardened, providing greater durability and better wear characteristics.

Preferably, the resulting curved surface (20) of the top (14) of the rail (10) is increased in hardness by at least five Rockwell points, more preferably at least ten Rockwell points, and most preferably at least fifteen Rockwell points.

Figure 7:
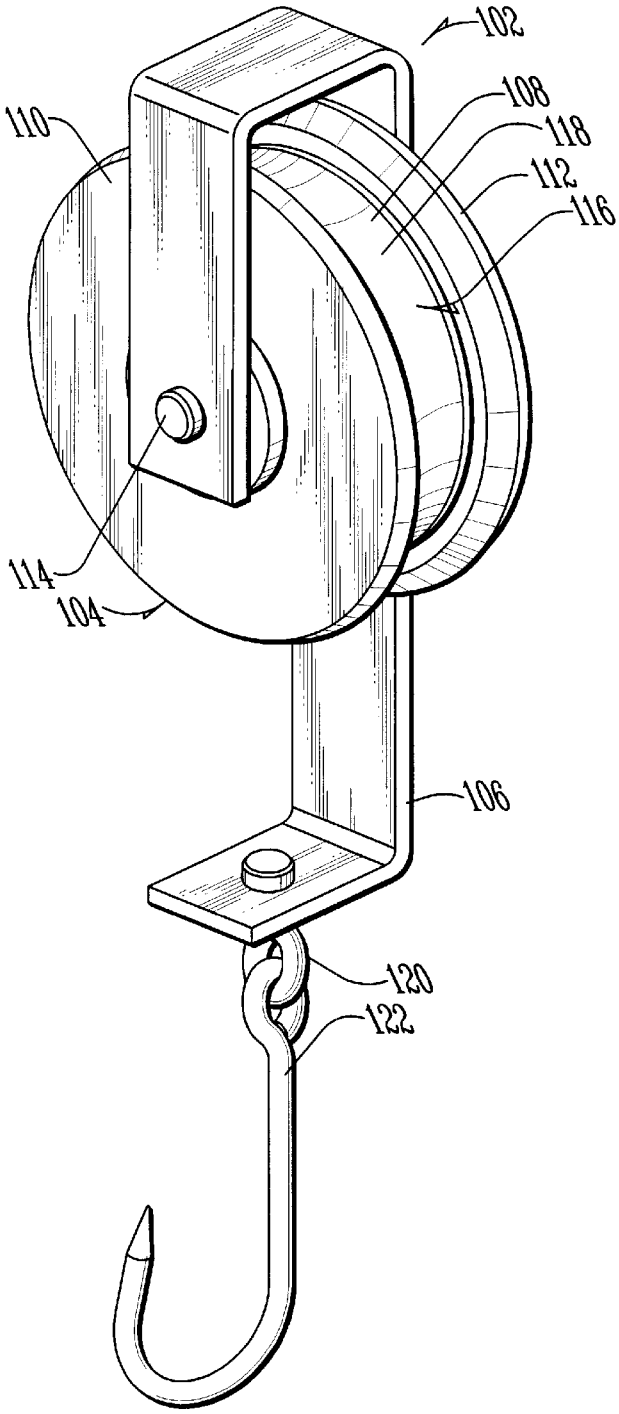
FIG. 7 illustrates a front elevation of a trolley used in association with the improved trolley rail of the present invention.

Once the rail (10) has been provided with the desired curved surface (20), a trolley (102) is provided to transport materials along the rail. The trolley (102) includes a wheel assembly (104) secured to a strap (106). The wheel assembly (104) includes an inner race (108) secured to two flanges (110) and (112). The entire wheel assembly (104) is preferably milled from stainless steel, cast iron or other suitable material. Alternatively, the flanges (110) and (112) may be bolted, welded or otherwise secured to the inner race (108) in a manner such as that well known in the art. As shown in FIG. 7, the wheel assembly (104) is journaled to the strap (106) by an axle (114). The axle (114) is preferably threadably engaged to the strap (106) to prevent inadvertent dislodgment during operation of the trolley (102).

Figure 8:
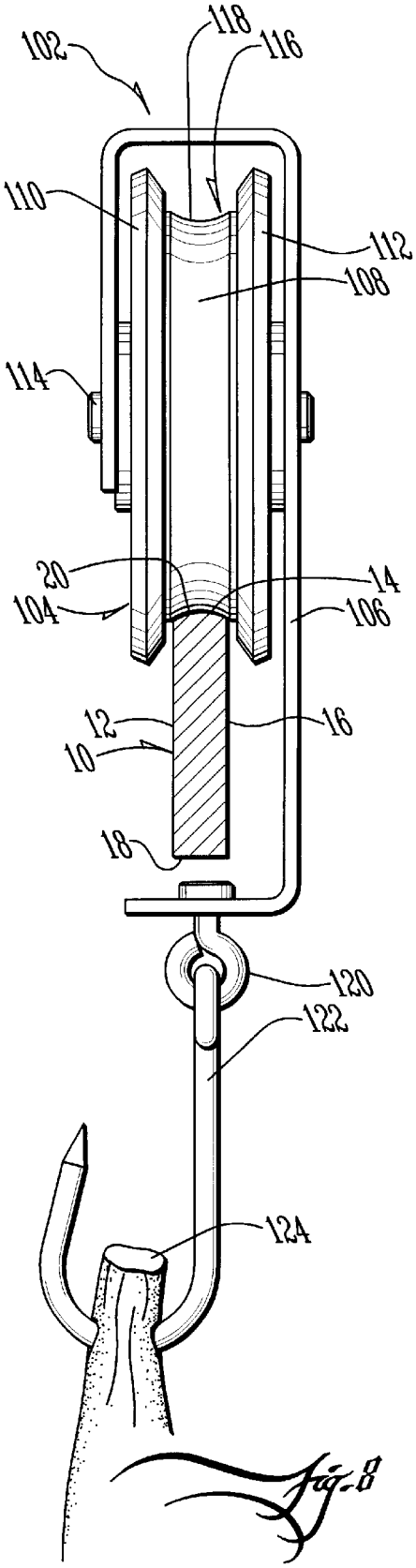
FIG. 8 illustrates a front elevation of the trolley of FIG. 7, moving along the improved trolley rail of the present invention, shown in partial cross-section.

The trolley (102), including the wheel assembly (104) and strap (106) may be provided with any suitable dimensions known in the art. Unlike prior art trolleys, however, the inner race (108), as shown in FIG. 8, is not provided with a flat perimeter but, instead, is provided with a partially concavely curved perimeter (116). As shown in FIG. 7, from the flanges (110) and (112), the perimeter of the inner race (108) initially extends normally toward the opposing flange, before curving inwardly to form the concavity identified generally as (118) in FIG. 8. Preferably, the concavity (118) of the inner race (108) defines a radius similar to the radius defined by the curved surface (20) of the top (14) of the rail (10) to allow mating engagement therewith, as shown in FIG. 8. As shown in FIG. 8, secured to the strap (106) is an eyebolt (120), which, in turn, is coupled to a meat hook (122). As shown in FIG. 8, the meat hook (122) is secured to an animal carcass (124) in a manner such as that known in the art.

As shown in FIG. 9, the concavity (118) of the wheel assembly (104) of the trolley (102) fits into mating engagement with the curved surface (20) of the top (14) of the rail (10). This mating engagement between the curved surfaces (20) and (118) acts to center and align the trolley (102) as it moves along the straightaways and curves provided on the rail (10), thereby reducing contact of the flanges (110) and (112) with the sides (12) and (16) of the rail (10). However, the flanges (110) and (112) do serve to maintain the trolley (102) on the rail (10) if the trolley (102) or carcass (124) are subjected to a violent force, or an irregularity in the rail (10).

Not only does the mating of the curved surfaces (20) and (118) act to center and align the trolley (102), this mating engagement also acts to dissipate the pressure of the carcass (124) over a larger surface area of the rail (10). Although prior art trolleys (not shown), having a wheel with a flat perimeter, may be used in association with the improved rail (10) of the present invention, utilizing a trolley (102) having an inner race (108), provided with a curved perimeter (116), increases the wear attributes of the trolley (102) and rail (10), and decreases the maintenance associated therewith. The curved surface (20) and concavity (118) also reduce the contact of the flanges (110) and (112) with the sides (12) and (16) of the rail (10).

Additionally, the process described above provides the top (14) of the rail (10) with a hardened surface. This hardened surface lasts longer than rails having milled or cast curvatures. Accordingly, as the rail (10) is constructed of stainless steel, with a hardened contact surface, and since the load is dissipated over a larger area of the rail (10), and contact of the rail (10) with the flanges (110) and (112) is reduced, prior art sources of contamination, such as metal abrasion are significantly reduced.

Although the invention has been described with respect to a preferred embodiment thereof, it is to be understood that it is not to be so limited, since changes and modifications can be made therein which are within the full, intended scope of this invention, as defined by the appended claims. For example, it is anticipated that instead of using a railmaking apparatus (42) such as that described above to form the curved surface (20) in the rail (10), an edging apparatus such as that described in U.S. Pat. No. 3,343,394 may be modified to provide additional rolls having recess sufficient to form the curved surface (20) of the rail (10) of the present invention, as may any other suitable edging devices known in the art. It is additionally anticipated that the improved rail (10) of the present invention may be used in association with trolleys (102) constructed of metal, composite, or any other suitable material, to further reduce wear characteristics aid contamination associated with prior art trolleys.

What is claimed is:

1. A process for creating a curved conveyor rail having a thickness greater than 0.5 centimeters, comprising:

(a) providing a rail having a first side, a second side, a third side, a first edge located between said first side and said second side, and a second edge located between said second side and said third side; and (b) pressing against said first edge and said second edge with sufficient force to increase the hardness of at least a portion of said second side at least five Rockwell points and to provide a substantially constant curvature across a majority of said second side.

2. The process of claim 1, wherein said pressing against said first edge and said second edge is done with sufficient force to increase the hardness of at least a portion of said second side at least five Rockwell points.

3. The process of claim 1, wherein said pressing against said first edge and said second edge is done with sufficient force to increase the hardness of the majority of said second side at least five Rockwell points.

4. The process of claim 3, wherein said substantially constant curvature is a curvature defining a radius less than ten centimeters.

5. The process of claim 3, wherein said substantially constant curvature is a curvature defining a radius less than five centimeters.

6. The process of claim 3, wherein said substantially constant curvature is a curvature defining a radius less than three centimeters.

7. The process of claim 3, wherein said substantially constant curvature is a curvature defining a radius less than two centimeters.

8. The process of claim 3, wherein said substantially constant curvature is a curvature defining a radius less than one centimeters.

9. The process of claim 3, wherein said pressing against said first edge and said second edge is done when said rail is at a temperature between negative about five degrees Celsius to about one-hundred five degrees Celsius.

10. The process of claim 3, wherein said pressing against said first edge and said second edge is done when said rail is at a temperature between about ten degrees Celsius to about seventy-five degrees Celsius.

11. A process for creating a curved conveyor rail having a thickness greater than 0.5 centimeters, comprising:

(a) providing a rail having a first side, a second side, a third side, a first edge located between said first side and said second side, and a second edge located between said second side and said third side; and (b) pressing against said first edge and said second edge with sufficient force to increase the hardness of at least a portion of said second side at least five Rockwell points and to provide said second side with a rounded surface of a substantially constant curvature from said first side to said third side.

12. The process of claim 11, wherein said rail is provided with a substantially rectangular cross-section.

13. The process of claim 12, wherein said pressing against said first edge and said second edge is done with sufficient force to increase the hardness of at least a portion of said second side at least fifteen Rockwell points.

14. The process of claim 11, wherein said rail is metal.

15. The process of claim 11, further comprising providing a die with a valley, having a first contact surface and a second contact surface, and wherein said pressing comprises forcing said first edge against said first contact surface and said second edge against said second contact surface with sufficient force to make at least a portion said second side arcuate.

16. A process for moving a wheel along a rail comprising:

(a) providing a rail having a thickness greater than 0.5 centimeters, a first side, a second side, a third side, a first edge located between said first side and said second side, and a second edge located between said second side and said third side;

(b) pinching said first edge and said second edge with sufficient force to increase the hardness of at least a portion of said second side at least five Rockwell points and provide said second side with a rounded surface of a substantially constant curvature from said first side to said third side;

(c) providing a wheel comprising:

(i) a concave perimeter wherein said concavity of said perimeter is of dimensions sufficient to fit into substantially mating engagement with said curvature of said second side; and (ii) rolling said wheel along said rail.

17. The process of claim 16, further comprising:

(a) positioning said rail with said curvature facing upward; and (b) depending a weight from said wheel below the rail.

18. The process of claim 17, wherein said weight is an animal carcass.

19. The process of claim 16, wherein prior to said pinching, said first side and said second side are of a substantially similar hardness on the Rockwell scale, and wherein after said pinching at least a portion of said second side is of a hardness at least ten Rockwell points greater than at least a portion of said first side.

* * * * *